US008277253B2

(12) United States Patent
Lee et al.

(10) Patent No.: US 8,277,253 B2
(45) Date of Patent: Oct. 2, 2012

(54) ELECTRICAL CONNECTOR AND CIRCUIT BOARD ASSEMBLY

(75) Inventors: Gang Lee, Shanghai (CN); Huibin Li, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 13/208,942

(22) Filed: Aug. 12, 2011

(65) Prior Publication Data

US 2012/0040540 A1 Feb. 16, 2012

(30) Foreign Application Priority Data

Aug. 12, 2010 (CN) ..... 2010 1 0253439

(51) Int. Cl.
*H01R 13/58* (2006.01)

(52) U.S. Cl. ..... 439/607.32; 439/607.35; 439/540.1

(58) Field of Classification Search ..... 439/607.32, 439/607.35, 540.1, 660, 65, 607.13, 607.23, 439/620.15, 620.16
See application file for complete search history.

(56) References Cited

U.S. PATENT DOCUMENTS 7,517,253 B1 * 4/2009 Chiang ..... 439/660
7,572,146 B1 8/2009 Chiang
7,833,065 B2 * 11/2010 Lin et al. ..... 439/639
7,845,982 B1 * 12/2010 Wang ..... 439/607.25

* cited by examiner

*Primary Examiner* — Edwin A. Leon
*Assistant Examiner* — Harshad Patel
(74) *Attorney, Agent, or Firm* — Barley Snyder

(57) ABSTRACT

An electrical connector adapted to electrically connect with a plug-type electrical connector of the periphery equipment of the computer. The electrical connector includes a housing, an insulating body, a plurality of first conductive terminals, and a plurality of second conductive terminals. The insulating body having a frame and a terminal block positioned within the frame. The plurality of first conductive terminals positioned along a first surface of the terminal block, while the plurality of second conductive terminals are positioned along a second surface of the terminal block. The plurality of first conductive terminals include a first ground terminal, while the plurality of second conductive terminals include a second ground terminal, and the first ground terminal and the second ground terminal share one free end leading out of the electrical connector.

27 Claims, 10 Drawing Sheets

ELECTRICAL CONNECTOR AND CIRCUIT BOARD ASSEMBLY

CROSS-REFERENCE TO RELATED APPLICATIONS

This application claims the benefit of the filing date under 35 U.S.C. §119(a)-(d) of Chinese Patent Application No. 201010253439.7 filed on Aug. 12, 2010.

FIELD OF INVENTION

The present invention is directed to an electrical connector, and more particularly, to an electrical connector compatible with both a USB (Universal Serial Bus) interface and for a eSATA (external Serial Advanced Technology Attachment) interface, and a circuit board assembly having the same.

BACKGROUND

In order to transmit data effectively between a computer and periphery equipments thereof, electrical connectors using different communication protocol specifications have been developed. These electrical connectors include a USB interface and a eSATA interface, etc.

With the development of the technology, the computer is becoming more compact to save space, thus, an electrical connector integrated with both the USB interface and the eSATA interface is proposed, and more specifically, conductive terminals of the USB interface and conductive terminals of the eSATA interface are provided respectively at two surfaces of one terminal block.

However, in an electrical connector integrated with both the eSATA interface and the USB interface, the conductive terminals for the USB interface and the conductive terminals for the eSATA interface are respectively and separately connected to corresponding connection terminals on a circuit board of the computer, and therefore larger space inside the computer is still occupied.

SUMMARY

The invention has been made to overcome or alleviate at least one aspect of the above mentioned disadvantages. The invention provides a socket-type electrical connector adapted to electrically connect with a plug-type electrical connector of the periphery equipment of the computer and also provides a circuit board assembly having the socket-type electrical connector. In the socket-type electrical connector, a ground terminal of the conductive terminals of the USB interface is also used as a ground terminal of the conductive terminals of the eSATA interface, hence, the number of the conductive terminals of the electrical connector to be electrically connected with the circuit board of the computer is decreased.

The electrical connector includes a housing, an insulating body, a plurality of first conductive terminals, and a plurality of second conductive terminals. The insulating body having a frame and a terminal block positioned within the frame. The plurality of first conductive terminals positioned along a first surface of the terminal block, while the plurality of second conductive terminals are positioned along a second surface of the terminal block. The plurality of first conductive terminals include a first ground terminal, while the plurality of second conductive terminals include a second ground terminal, and the first ground terminal and the second ground terminal share one free end leading out of the electrical connector.

BRIEF DESCRIPTION OF THE DRAWINGS

These and/or other aspects and advantages of the invention will become apparent and more readily appreciated from the following description of the embodiments, taken in conjunction with the accompanying drawings, in which.

DETAILED DESCRIPTION OF THE EMBODIMENT(S)

Figure 1:
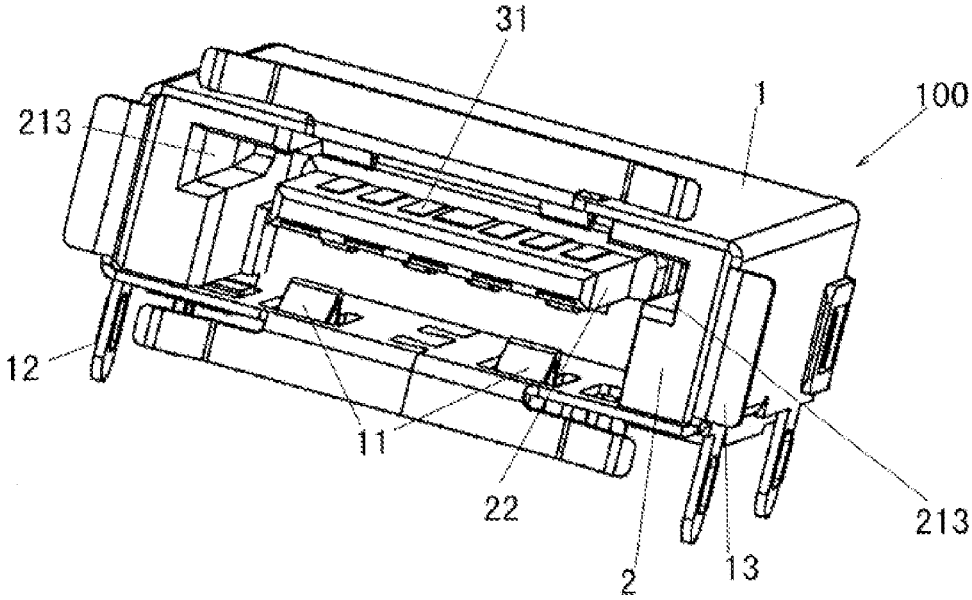
FIG. 1 is a perspective view of an electrical connector according to the invention.
Figure 2:
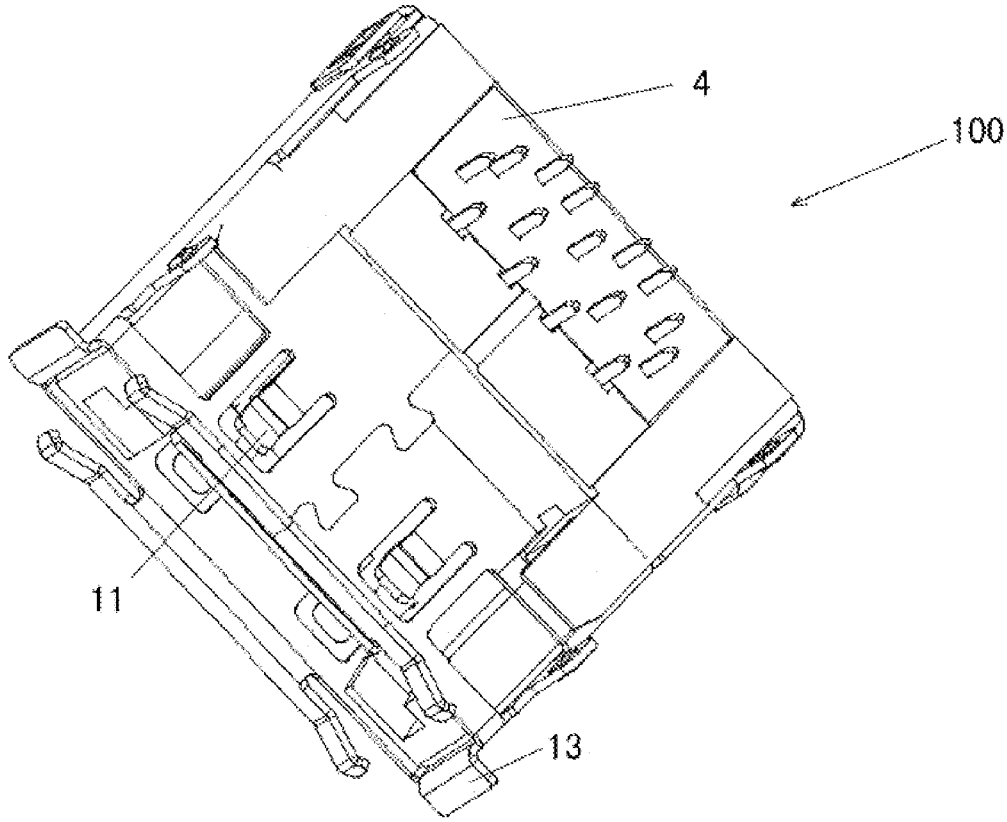
FIG. 2 is another perspective view of the electrical connector according to the invention.

The embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

Referring to FIGS. 1-16, an electrical connector 100 according to an embodiment of the invention is a socket-type electrical connector mounted to an electronic apparatus such as a computer. The electrical connector 100 is adapted to be electrically connected with plug-type electrical connectors of periphery equipments of the computer such as a USB memory, a display, a printer, and an electronic camera.

The electrical connector 100 includes a housing 1, an insulating body 2, a plurality of first conductive terminals 31, and a plurality of second conductive terminals 33. The housing 1 is formed by electric shielding material, for example, by a metal sheet. The insulating body 2 is made of, for example, polyurethane material, and includes a frame configured to combine with the housing 1 to receive the insulating body 2 in the housing 1, and a terminal block 22 provided within the frame, wherein the terminal block 22 has a first surface (for example, the upper surface in FIG. 1), a second surface (for example, the lower surface in FIG. 1) opposite to the first surface and an inserting end 222 for mating with another electrical connector. The plurality of (for example, 7) first conductive terminals 31 compliant with the eSATA specification, each of the plurality of first conductive terminals 31 include a first free end 313, a first connection section 311 opposite to the first free end 313 and a first middle section 312 located between the first free end 313 and the first connection section 311, wherein the first connection sections 311 are provided at the first surface of the terminal block 22. The plurality of (for example, 5) second conductive terminals 33 are configured under the USB 3.0 specification. Each of the plurality of second conductive terminals 33 includes a second free end 333, a second connection section 331 opposite to the second free end 333 and a second middle section 332 positioned between the second free end 333 and the second connection section 331. The second connection sections 331 is positioned at the second surface of the terminal. The plurality of first conductive terminals 31 include a first ground terminal 34 having a fourth connection section 341 and a fourth free end 343, while the plurality of second conductive terminals 33 include a second ground terminal having a fifth connection section 346 and a fifth free end, and the fourth connection section 341 is electrically connected with the fifth connection section 346 so that the first ground terminal and the second ground terminal share one free end 343 leading out of the electrical connector 100.

According to a shown embodiment of the electrical connector, the electrical connector 100 further includes a plurality of third conductive terminals 32 compliant with the USB 2.0 specification, each of the plurality of third conductive terminals 32 including a third free end 323, a third connection section 321 opposite to the third free end 323, and a third middle section 322 positioned between the third free end 323 and the third connection section 321. The third connection sections 321 is positioned at the second surface of the terminal block 22 and are electrically insulated from the second connection sections 331 respectively. Thus, the electrical connector according to the invention may be used as a socket-type electrical connector integrated with the USB 2.0 interface, the USB 3.0 interface and the eSATA interface, and if necessary it can be connected with a plug-type electrical connectors having the USB 2.0 interface, the USB 3.0 interface or the eSATA interface, so that data may be transmitted between the computer and different periphery equipments thereof.

In the embodiment shown, the frame of the insulating body 2 includes two first frame sections 211, and a second frame section 212 integrally formed between the two first frame sections 211. The terminal block 22 extends integrally from the second frame section 212 and ends with an inserting end 222 to form a tongue-shape structure. The inserting end is adapted to connect with a plug-type electrical connector. There is a predetermined distance between two sides of the terminal block 22 and inner sides of the two first frames in order that the plug-type electrical connector is connected to the terminal block 22. Two receiving passageways 213 (refer to FIGS. 1 and 2) are formed respectively at the inner sides of the two first frame sections so that the another electrical connector is inserted into the receiving passageways to mate with the electrical connector 100. For example, two side sections of the plug-type electrical connector (that is, the another electrical connector, not shown) compliant with the eSATA specification and having a larger width are received in the receiving passageways 213.

Figure 9:
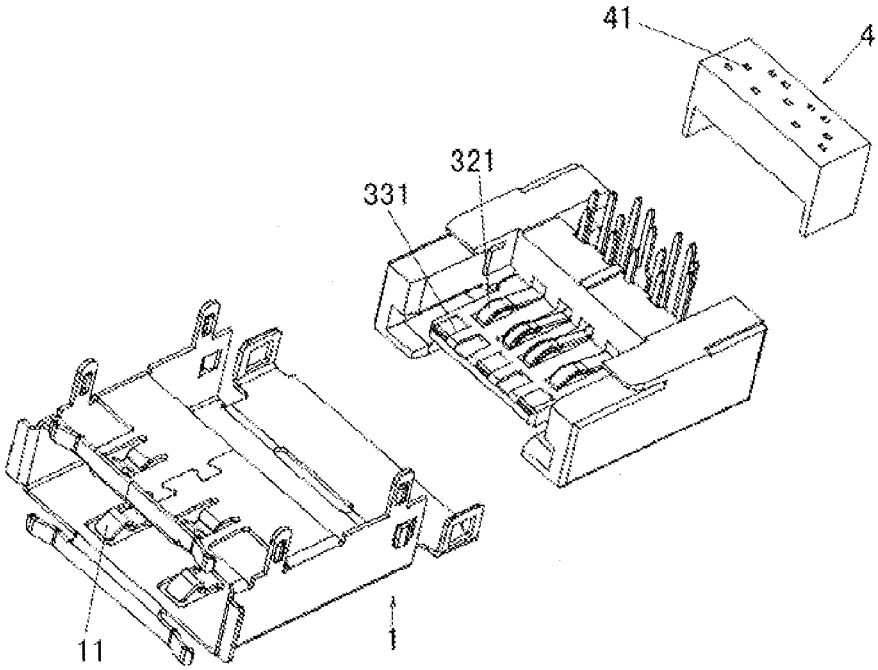
FIG. 9 is another exploded perspective view of the electrical connector in FIG. 1, in which respective conductive terminals assembled with an insulating body.
Figure 10:
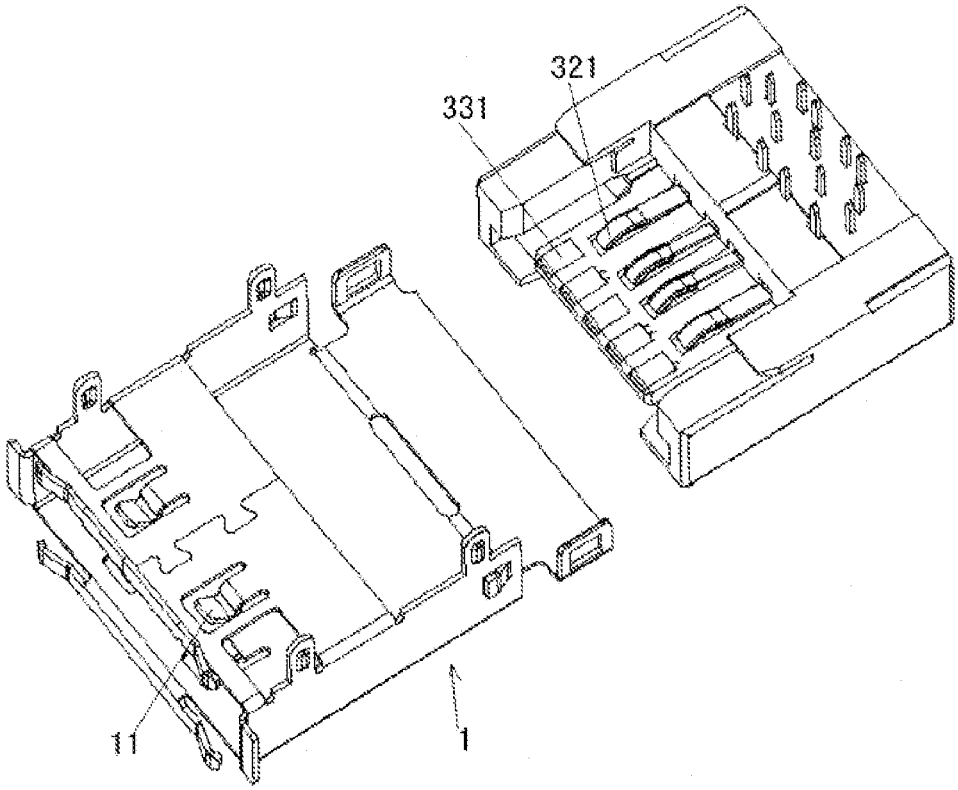
FIG. 10 is an exploded perspective view of the electrical connector in FIG. 1, in which the conductive terminals, the insulating body and a terminal locator have been assembled together.

Referring to FIGS. 4-7, a plurality of terminal receiving passageways 221 are formed on the two opposite first and second surfaces of the terminal block 22 of the insulating body 2. The connection sections of the first, second and third conductive terminals 31, 33 and 32 run through the second frame section 212 respectively and are secured in the respective terminal receiving passageways 221 through bonding, or by using plastic molding. Because the second conductive terminals 33 and the third conductive terminals 32 are positioned at the second surface of the terminal block 22, for save space and as shown in FIGS. 9 and 10, the second connection sections 331 and the second middle sections 332 of the plurality of second conductive terminals 33, and the third connection sections 321 and the third middle sections 322 of the plurality of third conductive terminals 32 are alternately positioned in a width direction of the electrical connector 100, and arranged in parallel. At the same time, the second connection sections 331 of the second conductive terminals 33 and the third connection sections 321 of the third conductive terminals 32 are staggered in a length direction of the electrical connector 100 (or a direction in which the another electrical connector is inserted) perpendicular to the width direction thereof. In one embodiment, the third connection sections 321 of the third conductive terminals 32 are positioned farther away from the inserting end 222 of the terminal block 22 than the second connection sections 331 of the second conductive terminals 33 in the length direction.

The first conductive terminals 31, the second conductive terminals 33 and the third conductive terminals 32 may be made of flat sheet metal, such as copper sheet, and have different structures or shapes.

More specifically, with reference to FIGS. 13-16, the first conductive terminal 31 is in a substantially "L" shape, and includes the first free end 313 for connecting with, for example, a circuit board, the first connection section 311 which is opposite to the first free end 313 and is used for electrically connecting with the corresponding conductive terminal of a plug-type eSATA electrical connector, and the first middle section 312 located between the first connection section 311 and the first free end 313. For the first conductive terminal 31, the first free end 313, the first connection section 311 and the first middle section 312 have substantially the same width. The shape of the third conductive terminal 32 is substantially the same as that of the first conductive terminal 31, and includes the third free end 323, the third connection section 321 and the third middle section 322. However, the difference between the third conductive terminal 32 and the first conductive terminal 31 lies in that the third connection section 321 of the third conductive terminal 32 has a substantially arc shape so that the third connection section 321 protrudes from the terminal receiving passageway 221 of the terminal block 22 beyond the second surface of the terminal block 22. Accordingly, the electrical connector 100 is adapted to electrically connect with conductive terminals of a plug-type USB 2.0 electrical connector (not shown). The shape of the second conductive terminal 33 is substantially the same as that of the first conductive terminal 31, and includes the second free end 333, the second connection section 331 and the second middle section 332. However, the difference between the second conductive terminal 33 and the first conductive terminal 31 lies in that the second connection section 331 of the second conductive terminal 33 is wider than the second middle section 332. Hence, not only can the third connection section 321 and the third middle section 322 of one third conductive terminal 32 can be arranged between the second middle sections 332 of two second conductive terminals 33, but the wider second connection section 331 of the second conductive terminal 33 can also be positioned beyond the third connection section 321 of the third conductive terminal 32. In this way, the electrical connector 100 is adapted to electrically connect with conductive terminals of a plug-type USB 3.0 electrical connector (not shown).

Figure 8:
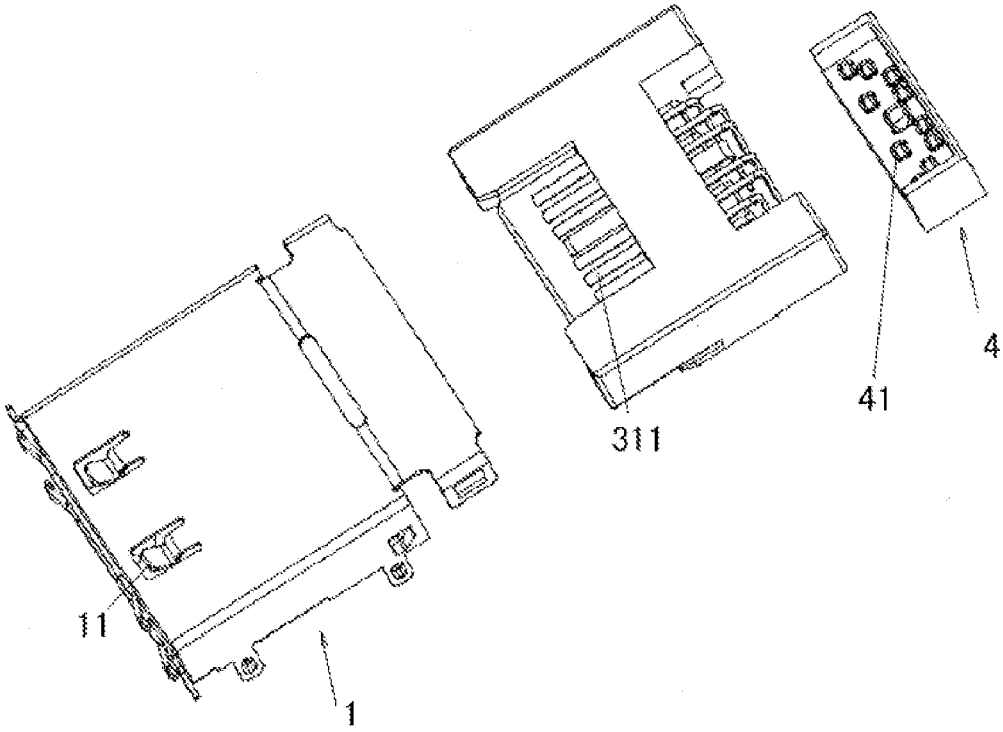
FIG. 8 is an exploded perspective view of the electrical connector in FIG. 1, in which respective conductive terminals assembled with an insulating body.
Figure 11:
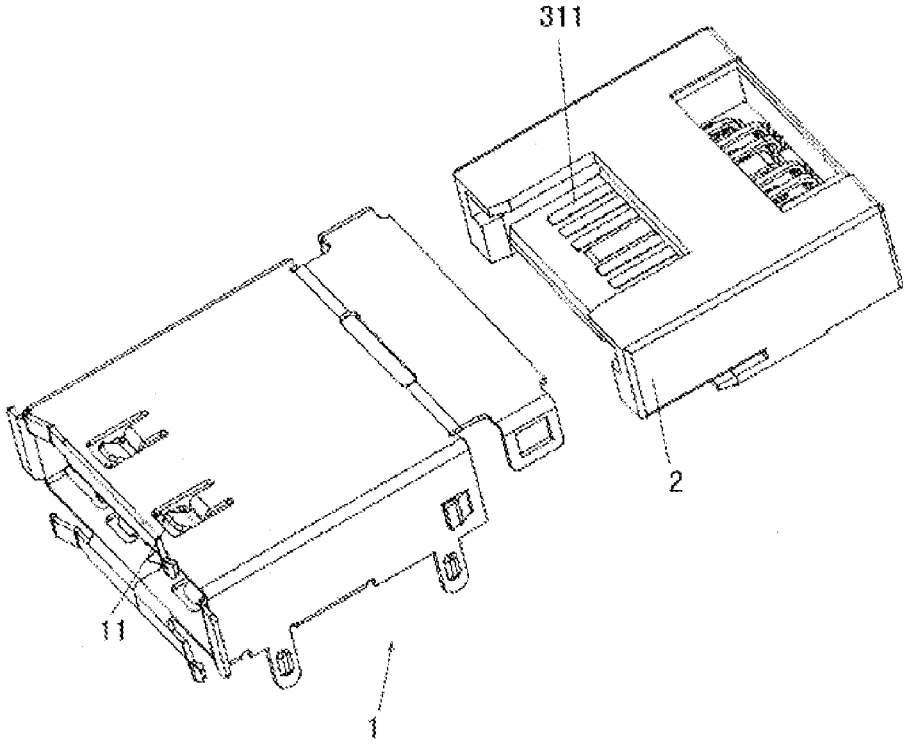
FIG. 11 is another exploded perspective view of the electrical connector in FIG. 1, in which the conductive terminals, the insulating body and a terminal locator have been assembled together.

In the embodiment shown in FIGS. 8 and 11, the first connection sections 311 of the first conductive terminals 31 and the second connection sections 331 of the second conductive terminals 33 are staggered in the length direction. Specifically, the first connection sections 311 of the first conductive terminals 31 are farther away from the inserting end 222 of the terminal block 22 than the second connection sections 331 of the second conductive terminals 33.

Figure 12:
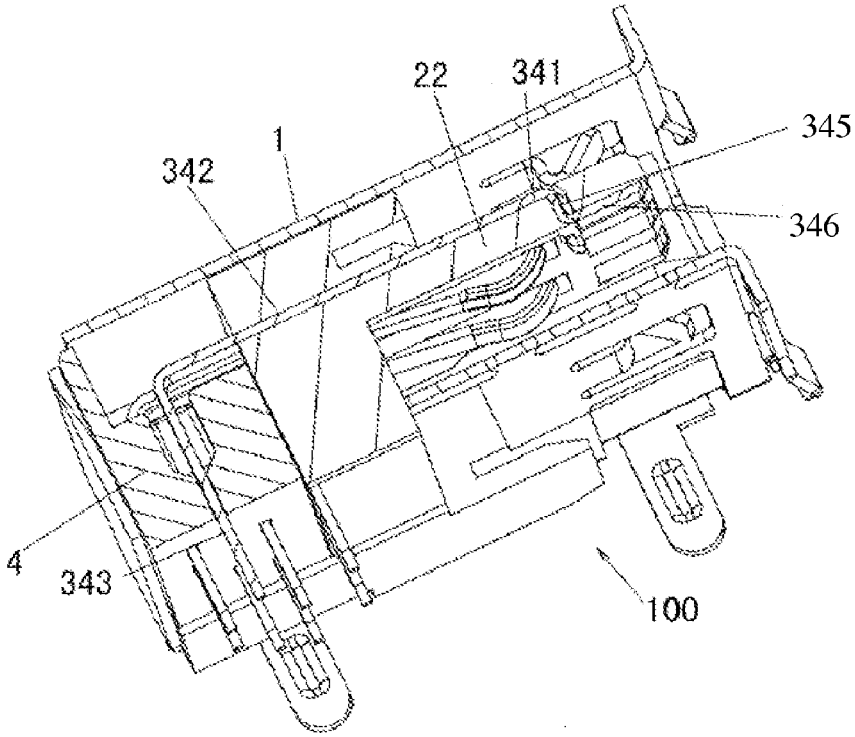
FIG. 12 is a sectional view along a longitudinal central line of the electrical connector in FIG. 1.
Figure 13:
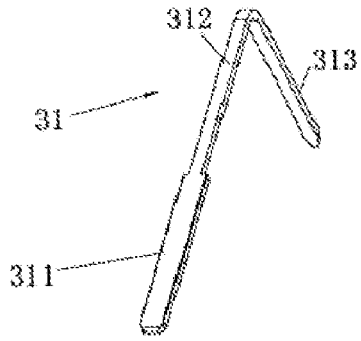
FIG. 13 is a perspective view of a first conductive terminal according the invention, compliant with the eSATA specification.
Figure 14:
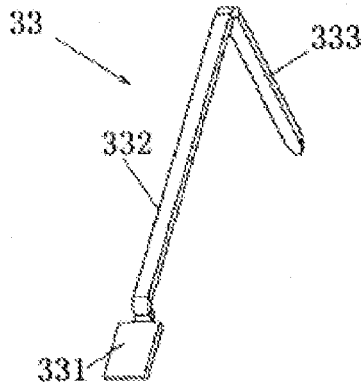
FIG. 14 is a perspective view of a second conductive terminal according to the invention, compliant with the USB 3.0 specification.
Figure 15:
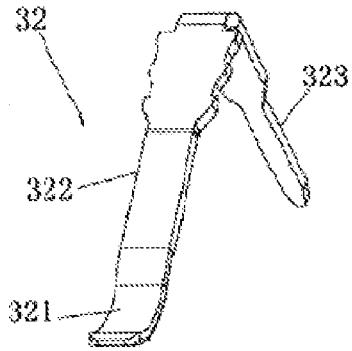
FIG. 15 is a perspective view of a third conductive terminal according to one the invention, under USB 2.0 specification.
Figure 16:
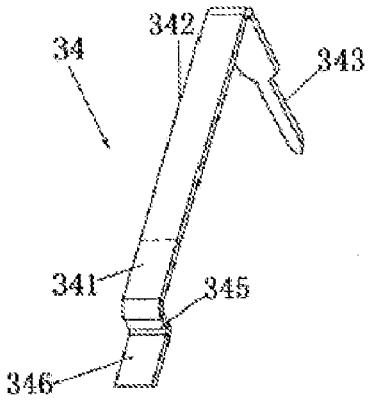
FIG. 16 is a perspective view of a ground terminal according to the invention.

As shown in FIGS. 12 and 16, the plurality of first conductive terminals 31 include one first ground terminal 34 having the fourth connection section 341 and the fourth free end 343. The plurality of second conductive terminals 33 include one second ground terminal having a fifth connection section 346 and the fifth free end; and the fourth connection section 341 is electrically connected with the fifth connection section 346 so that the first ground terminal and the second ground terminal share one free end 343. Further, the first connection sections 311 and the fourth connection section 341 are farther away from the inserting end 222 of the terminal block 22 than the second connection sections 331 and the fifth connection section in the length direction of the electrical connector 100. An end of the fourth connection section 341 is bent to extend through the terminal block 22 from the first surface to the second surface, and is then bent to form the fifth connection section such that the fourth free end 343 and the fifth free end share one free end. Accordingly, the first ground terminal 34 in the first conductive terminals 31 is also used as the second ground terminal in the second conductive terminals 33. Specifically, as shown in FIG. 16, the fourth connection section 341, the fourth middle section 342 and the fourth free end 343 of the first ground terminal 34 in the first conductive terminals 31 substantially have the same shapes as other first conductive terminals 31, the only difference between the first ground terminal 34 and the other first conductive terminals 31 lies in that the fourth connection section 341 of the first ground terminal 34 is first bent to form a bending section 345 extending through the terminal block 22 in a thickness direction thereof, and then is further bent to be formed as the fifth connection section 346 of the second ground terminal in the second conductive terminals 33.

According to the invention, the electrical connector 100 further includes a terminal locator 4 on which a plurality of via holes 41 are provided, wherein the first free ends 313 of the first conductive terminals 31, the second free ends 333 of the second conductive terminals 33, the third free ends 323 of the third conductive terminals 32, and the fourth free end (that is, the shared free end 343) of the first ground terminal 34 run through the via holes 41 respectively. Thus, the free ends are positioned respectively and are electrically insulated from one another. Though in the figures, each of the free ends of the conductive terminals is perpendicular to the middle sections, those skilled in the art will know that the free ends of the conductive terminals may extend in parallel with respect to the middle sections.

As shown in FIGS. 7-10, when the electrical connector 100 according to the invention is assembled, first, each of the conductive terminals is secured into the corresponding terminal receiving passageway 221 of the terminal block 22 of the insulating body 2, then, the free ends of the conductive terminals are run through the via holes 41 of the terminal locator 4 so that the terminal locator 4 is mounted to one end of the insulating body 2. Finally, the insulating body 2 having the conductive terminals and the terminal locator 4 mounted thereon is assembled into the housing 1 to form the electrical connector 100 according to the invention.

According to another aspect of the invention, a circuit board assembly is provided. The circuit board assembly includes any one of the above electrical connectors 100 and a circuit board 200 having a plurality of connection terminals (not shown), wherein, the connection terminals of the circuit board 200 are respectively electrically connected with the free ends of the corresponding conductive terminals of the electrical connector, and the free end 343, leading out of the electrical connector, of the shared one ground terminal 34 is electrically connected with a ground terminal (not shown) of the circuit board 200. Specifically, referring to FIGS. 17-19, terminal receiving connection passageways 201, 203 are provided correspondingly at each of the connection terminals of the circuit board 200. The first, second and third free ends 313, 333, 323 and the shared free end 343 are inserted into and welded or soldered to the corresponding terminal receiving connection passageways respectively, wherein the free end 343, leading out of the electrical connector 100, of the one shared ground terminal 34 is inserted into the terminal receiving connection passageway 203 of the circuit board 200 for connecting with the ground terminal.

Figure 3:
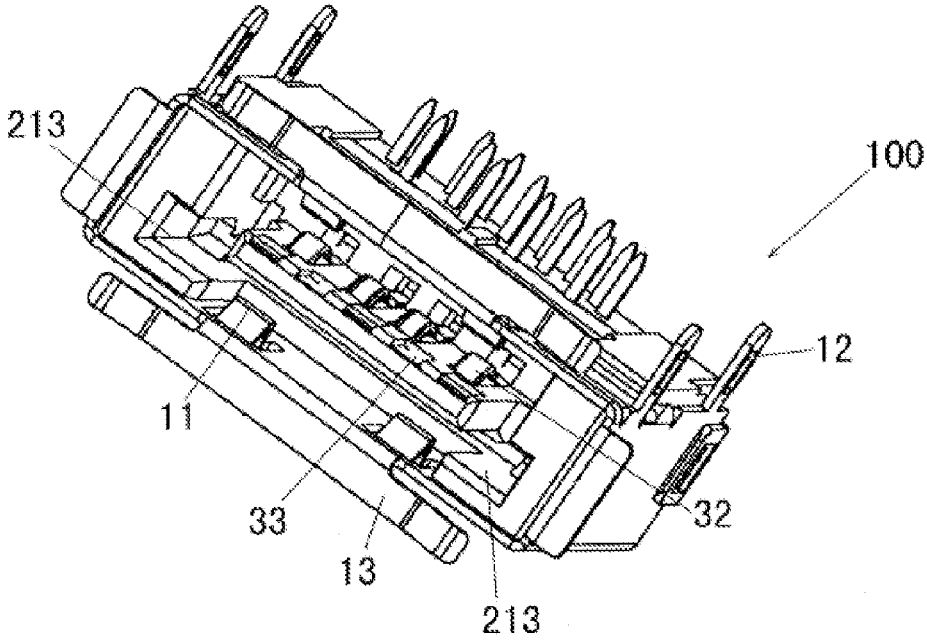
FIG. 3 is another perspective view of the electrical connector according to the invention.
Figure 4:
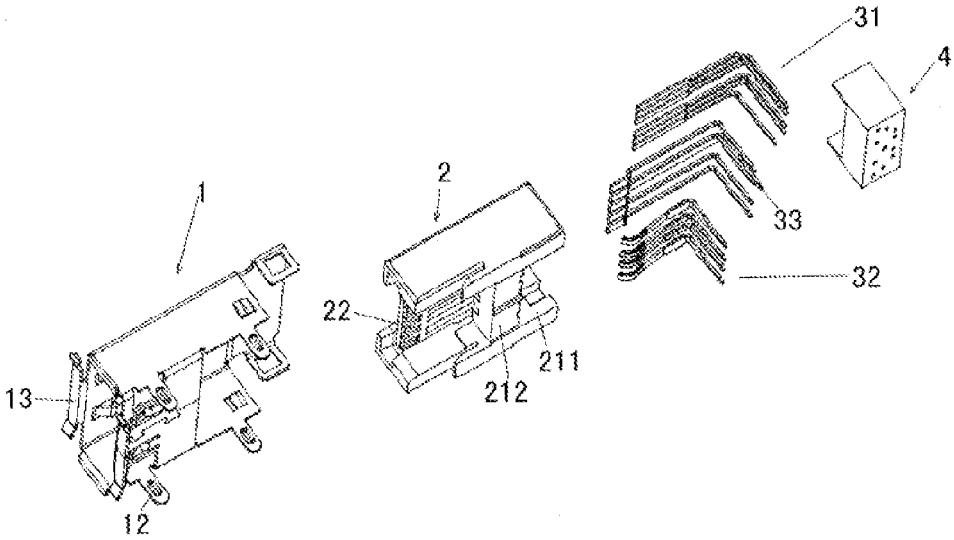
FIG. 4 is an exploded perspective view of the electrical connector according to the invention, shown from the bottom.
Figure 5:
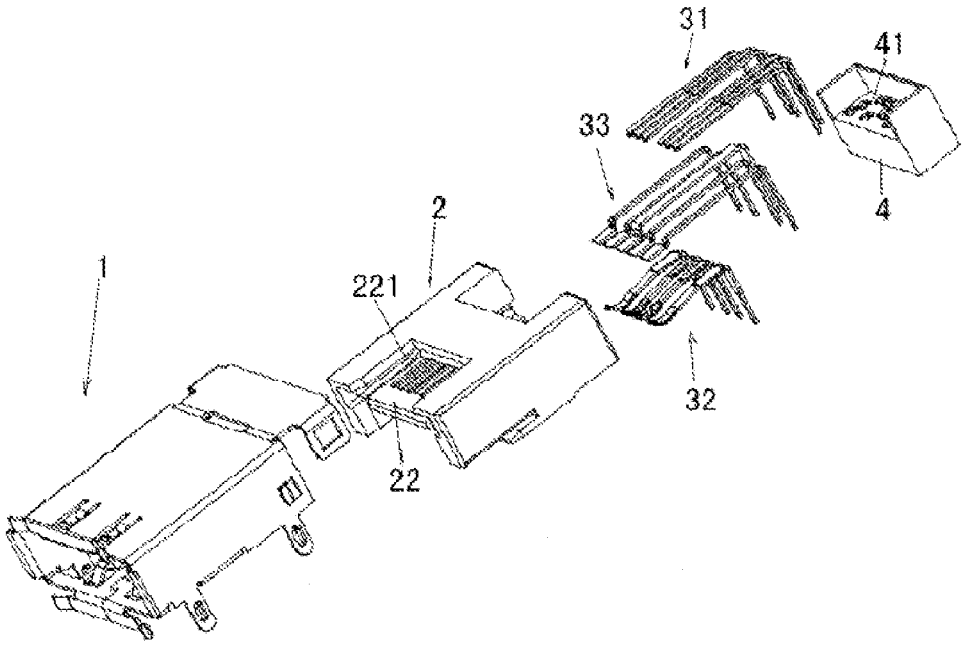
FIG. 5 is an exploded perspective view of the electrical connector according to the invention, shown from the top.
Figure 6:
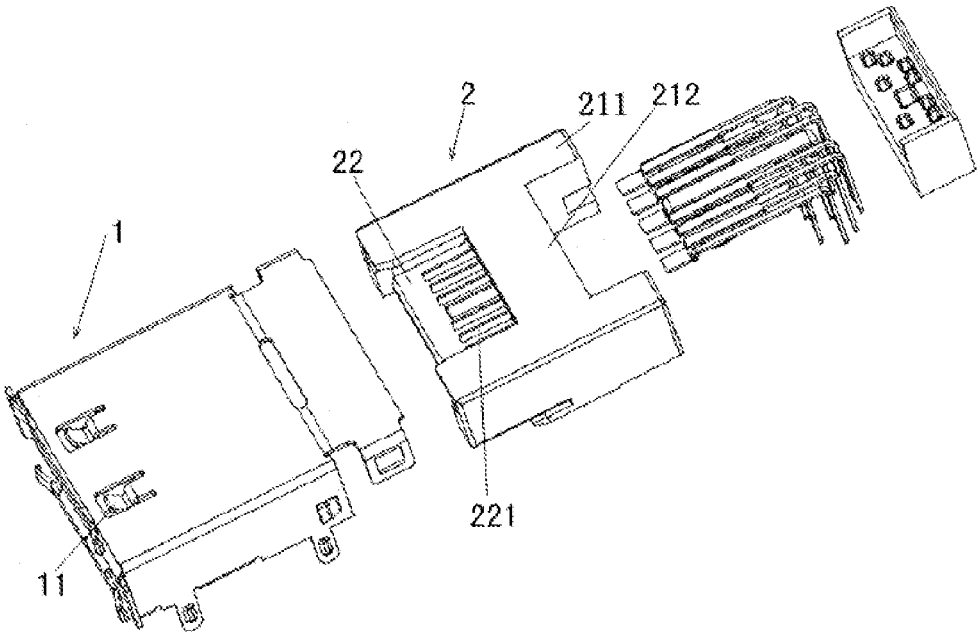
FIG. 6 is another exploded perspective view of the electrical connector according to the invention.
Figure 7:
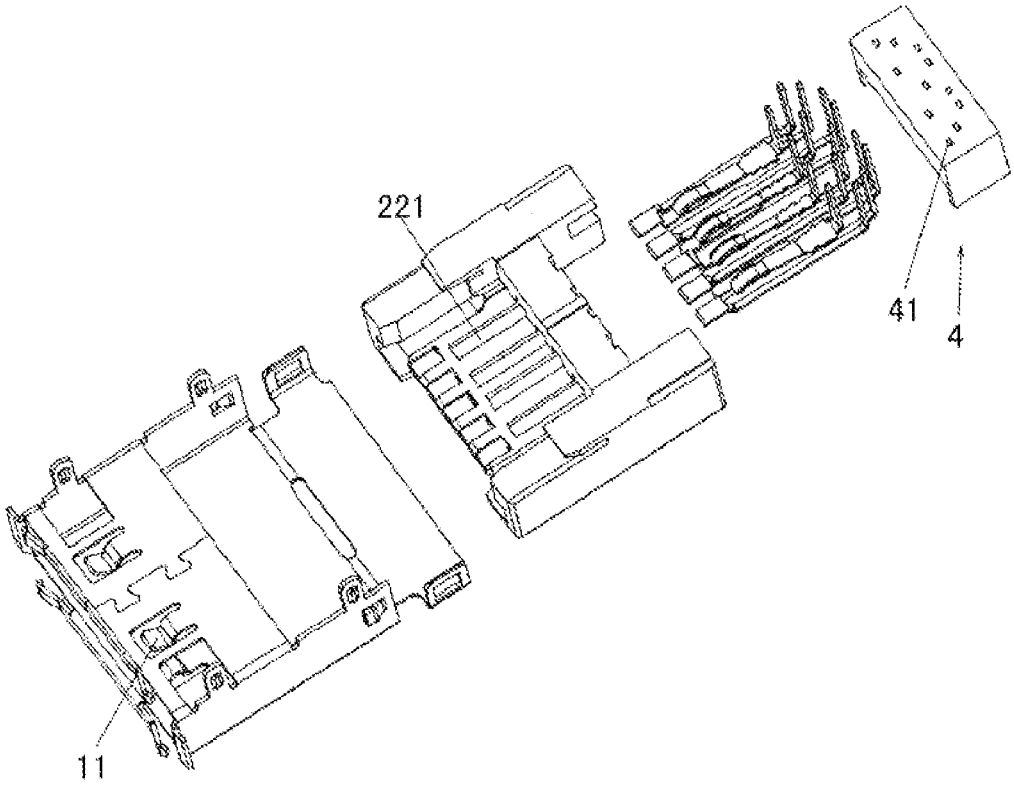
FIG. 7 is another exploded perspective view of the electrical connector according to the invention.
Figure 17:
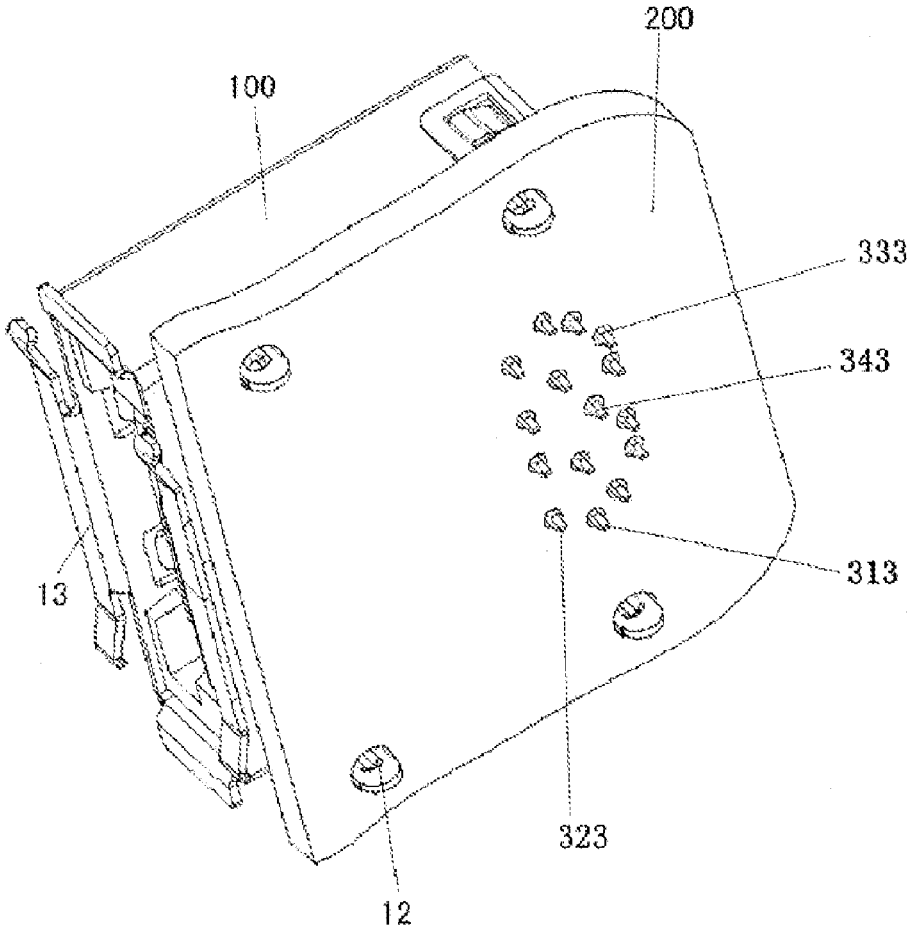
FIG. 17 is a perspective view of a circuit board assembly according to the invention.
Figure 18:
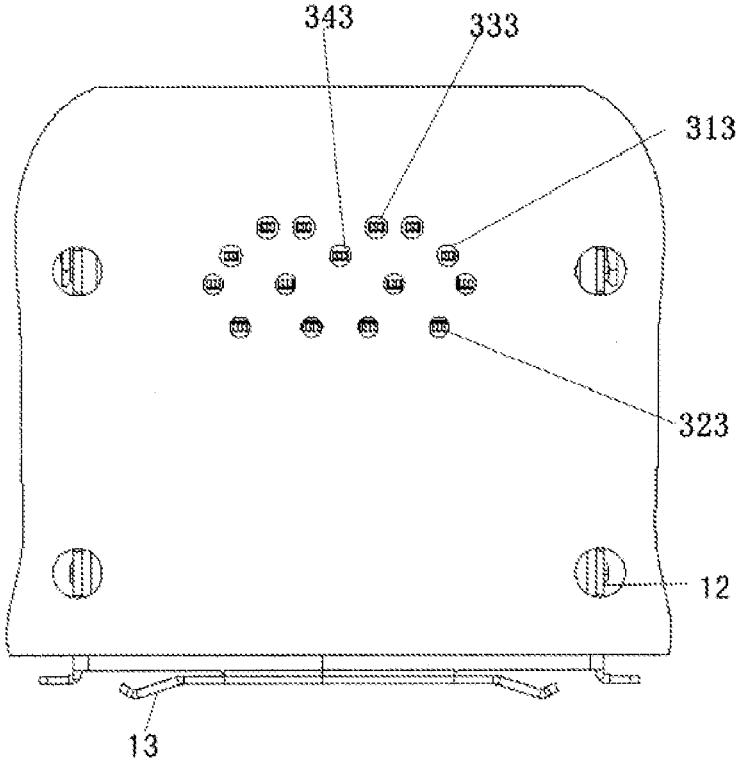
FIG. 18 is a side view of a circuit board side of the circuit board assembly shown in FIG. 17.
Figure 19:
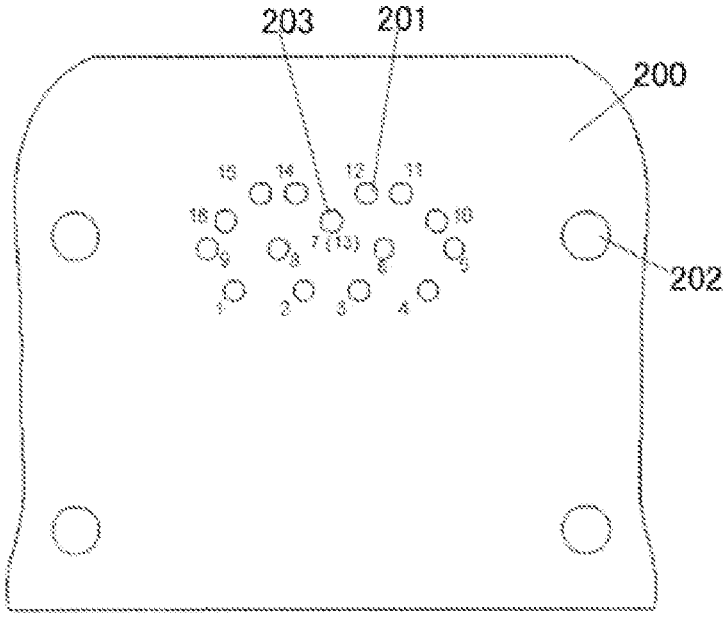
FIG. 19 is a side view of the circuit board after the electrical connector is removed from the circuit board assembly shown in FIG. 18.

As described above, since the first ground terminal of the first conductive terminal 31 and the second ground terminal of the second conductive terminal 33 share one ground terminal 34, the number of the free ends of the conductive terminals leading out of the electrical connector at the terminal locator 4 is decreased by one with respect to the number of the connection sections of the conductive terminals at the inserting end 222. For example, in one embodiment, the electrical connector 100 includes 7 connection sections compliant with the eSATA specification (as shown in FIGS. 1 and 8), 4 connection sections compliant with the USB 2.0 specification (as shown in FIGS. 3, 9 and 10), and 5 connection sections compliant with the USB 3.0 specification (as shown in FIGS. 3, 9 and 10), thus, there are 16 connection sections in total. However, referring to FIGS. 2 and 10, there are 15 free ends leading out of the electrical connector at the terminal locator 4. As shown in FIGS. 17-19, since one free end of the conductive terminals for grounding is omitted, the number of the terminal receiving connection passageways in the circuit board 200 for electrically connecting with the free ends is reduced by one. Specifically, as shown in FIG. 19, the seventh terminal receiving connection passageway and the thirteenth terminal receiving connection passageway form one shared terminal receiving connection passageway 203. Therefore, the times of connecting the free ends of the conductive terminals to the circuit board are decreased, and the likelihood of electrical connection fault caused by poor welding or soldering between the free ends of the ground terminals of the electrical connector and the ground terminals of the circuit board is reduced.

The above has described the embodiments in which the connection section of the ground terminal compliant with the USB 3.0 specification is formed by further bending the connection section of the ground terminal in the first conductive terminals compliant with the eSATA specification, however, the invention is not limited to this. Those skilled in the art will understand that when the first ground terminal of the first conductive terminals 31 and the second ground terminal of the second conductive terminals 33 share one free end, the electrical connection between the fourth connection section of the first ground terminal in the first conductive terminals 31 and the fifth connection section of the second ground terminal in the second conductive terminals 33 may be obtained by using various structures, for example, the first ground terminal in the second conductive terminals compliant with the USB 3.0 specification is further bent at the fourth connection section thereof to form a connection section of a ground terminal compliant with the eSATA specification. In addition, after the first ground terminal of the first conductive terminals 31 and the second ground terminal of the second conductive terminals 33 have been arranged, the free ends of the ground terminals thereof are electrically connected with each other at the terminal locator 4 and are made to run through the shared via hole 41, thereby forming one shared ground terminal leading out of the electrical connector 100.

According to a further embodiment of the present, referring to FIGS. 1-3 and 6-11, at one or two of two side surfaces of the housing 1 facing the first and second surfaces of the terminal block 22, at least one connector indicator 11 is provided to indicate that the plug-type electrical connector (not shown) has been inserted into the socket-type electrical connector 100. Further, the at least one connector indicator 11 may be an elastic metal sheet which is integrally with the housing 1 and protrudes inwards of the housing 1.

In addition, referring to FIGS. 1-4, the electrical connector 100 further includes a plurality of pins 12 which are positioned at side sections of the housing 1 facing and extending toward the circuit board 200. Correspondingly, as shown in FIG. 19, the circuit board 200 includes a plurality of pin receiving mounting passageways 202, the pins 12 are inserted into and combined with the pin receiving mounting passageways 202 respectively so that the electrical connector 100 is mechanically secured to the circuit board 200. Further, also provided at one side of the electrical connector 100 for mating with the plug-type electrical connector are a plurality of mounting sections 13 through which the electrical connector 100 may be mounted to a housing of the computer.

The socket-type electrical connector 100 according to the invention is integrated with the eSATA interface, the USB 2.0 interface and the USB 3.0 interface. The socket-type electrical connector 100 can mate with the plug-type electrical connectors compliant with the eSATA specification, the USB 2.0 specification and the USB 3.0 specification of different periphery equipments of the computer, in this way, and as a result, the structure of the computer is simplified. Further, in the electrical connector according to the invention, though the protocol specifications of transmitting data for the conductive terminals compliant with the eSATA specification and the USB 3.0 specification are different, both the conductive terminals compliant with the eSATA specification and USB 3.0 specification have ground terminals for electrically connecting with ground terminals of the circuit board. Thus, the ground terminals of the conductive terminals compliant with the eSATA specification and USB 3.0 specification share one ground terminal, which reduces the number of the conductive terminals and the times of electrically connecting the free ends of the conductive terminals with the circuit board, and at the same time different data transmission functions are ensured.

Although several embodiments have been shown and described, it would be appreciated by those skilled in the art that various changes or modifications may be made in these embodiments without departing from the principles and spirit of the disclosure, the scope of which is defined in the appended claims and their equivalents. Please be noted that the words "comprise", "includes", "have" do not exclude other components, and the word "a" or "one" does not exclude "many".

What is claimed is:

1. An electrical connector, comprising:

an insulative body having a frame and a terminal block positioned within the frame, the terminal block having a first surface, a second surface opposite to the first surface and an inserting end;

a plurality of first conductive terminals positioned along the first surface of the terminal block, each of the plurality of first conductive terminals having a first free end, a first connection section opposite to the first free end and a first middle section located between the first free end and the first connection section; and a plurality of second conductive terminals positioned along the second surface of the terminal block, each of the plurality of second conductive terminals having a second free end, a second connection section opposite to the second free end and a second middle section located between the second free end and the second connection section;

wherein the plurality of first conductive terminals include a first ground terminal having a fourth connection section and a fourth free end, the plurality of second conductive terminals include a second ground terminal having a fifth connection section and a fifth free end, the fourth connection section electrically connects with the fifth connection section so that the first ground terminal and the second ground terminal share one free end leading out of the electrical connector.

2. The electrical connector according to claim 1, further comprising a plurality of third conductive terminals with each of the plurality of third conductive terminals having a third free end, a third connection section opposite to the third free end, and a third middle section located between the third free end and the third connection section.

3. The electrical connector according to claim 2, wherein the third connection sections are positioned along the second surface of the terminal block and are electrically insulated from the second connection sections respectively.

4. The electrical connector according to claim 3, wherein the second connection sections and the third connection sections are alternately arranged parallel to each other along a width direction of the electrical connector.

5. The electrical connector according to claim 4, wherein the second connection sections and the third connection sections are staggered in a length direction of the electrical connector perpendicular to the width direction.

6. The electrical connector according to claim 5, wherein the first connection section and the second connection sections are staggered in the length direction.

7. The electrical connector according to claim 1, wherein the first connection sections and the fourth connection section are positioned farther away from the inserting end of the terminal block than the second connection sections and the fifth connection section in a length direction of the electrical connector perpendicular to a width direction thereof.

8. The electrical connector according to claim 7, wherein an end of the fourth connection section is bent to extend through the terminal block from the first surface to the second surface.

9. The electrical connector according to claim 8, wherein the end of the fourth connection section is then bent to form the fifth connection section such that the fourth free end and the fifth free end share the one free end leading out of the electrical connector.

10. The electrical connector according to claim 1, further comprising a terminal indicator on which a plurality of via holes are positioned.

11. The electrical connector according to claim 10, wherein the first free ends, the second free ends, the third free ends, and the fourth free end run through the via holes respectively.

12. The electrical connector according to claim 1, wherein the frame includes two first frame sections, and a second frame section integrally formed between the two first frame sections, the terminal block extending from the second frame section.

13. The electrical connector according to claim 12, further comprising two receiving passageways positioned respectively along inner sides of the two first frame sections.

14. A circuit board assembly comprising:

a circuit board having a plurality of connection terminals; and an electrical connector comprising:

an insulating body having a frame and a terminal block positioned within the frame, the terminal block having a first surface, a second surface opposite to the first surface and an inserting end;

a plurality of first conductive terminals positioned along the first surface of the terminal block, each of the plurality of first conductive terminals having a first free end, a first connection section opposite to the first free end and a first middle section located between the first free end and the first connection section; and a plurality of second conductive terminals positioned along the second surface of the terminal block, each of the plurality of second conductive terminals having a second free end, a second connection section opposite to the second free end and a second middle section located between the second free end and the second connection section;

wherein the plurality of first conductive terminals include a first ground terminal having a fourth connection section and a fourth free end, and the plurality of second conductive terminals include a second ground terminal having a fifth connection section and a fifth free end, the fourth connection section electrically connects with the fifth connection section so that the first ground terminal and the second ground terminal share one free end leading out of the electrical connector;

wherein the plurality of connection terminals are respectively connected with free ends of the corresponding first plurality of first and second conductive terminals of the electrical connector, and the shared one free end leading out of the electrical connector is electrically with a ground terminal of the circuit board.

15. The circuit board assembly according to claim 14, wherein the electrical connector includes a plurality of pins and the circuit board has a plurality of pin receiving mounting passageways, the plurality of pins are respectively inserted into and combined with the plurality of pin receiving mounting passageways so that the electrical connector is mechanically fixed to the circuit board.

16. The electrical connector according to claim 15, further comprising a plurality of third conductive terminals with each of the plurality of third conductive terminals having a third free end, a third connection section opposite to the third free end, and a third middle section located between the third free end and the third connection section.

17. The electrical connector according to claim 16, wherein the third connection sections are positioned along the second surface of the terminal block and are electrically insulated from the second connection sections respectively.

18. The electrical connector according to claim 17, wherein the second connection sections and the third connection sections are alternately arranged parallel to each other along a width direction of the electrical connector.

19. The electrical connector according to claim 18, wherein the second connection sections and the third connection sections are staggered in a length direction of the electrical connector perpendicular to the width direction.

20. The electrical connector according to claim 19, wherein the first connection sections and the second connection sections are staggered in the length direction.

21. The electrical connector according to claim 15, wherein the first connection sections and the fourth connection section are positioned farther away from the inserting end of the terminal block than the second connection sections and the fifth connection section in a length direction of the electrical connector perpendicular to a width direction thereof.

22. The electrical connector according to claim 21, wherein an end of the fourth connection section is bent to extend through the terminal block from the first surface to the second surface.

23. The electrical connector according to claim 22, wherein the end of the fourth connection section is then bent to form the fifth connection section such that the fourth free end and the fifth free end share the one free end leading out of the electrical connector.

24. The electrical connector according to claim 15, further comprising a terminal indicator on which a plurality of via holes are positioned.

25. The electrical connector according to claim 24, wherein the first free ends, the second free ends, the third free ends, and the fourth free end run through the via holes respectively.

26. The electrical connector according to claim 15, wherein the frame includes two first frame sections, and a second frame section integrally formed between the two first frame sections, the terminal block extending from the second frame section.

27. The electrical connector according to claim 26, further comprising two receiving passageways positioned respectively along inner sides of the two first frame sections.

* * * * *